United States Patent [19]

Mertes

[11] 4,109,338

[45] Aug. 29, 1978

[54] BROOM AND DUSTPAN COMBINATION

[76] Inventor: Richard H. Mertes, 26727 Brahms Dr., Westlake, Ohio 44145

[21] Appl. No.: 619,821

[22] Filed: Oct. 6, 1975

[51] Int. Cl.[2] ..... A46B 15/00; A47L 13/52

[52] U.S. Cl. ..... 15/105; 15/168; 15/257.2

[58] Field of Search ..... 15/104.8, 105, 168–170, 15/257.2, 248 R, 247; D7/186; 248/111

[56] References Cited

U.S. PATENT DOCUMENTS

| | | | |
|---|---|---|---|
| 345,069 | 7/1886 | Nash | 15/257.2 |
| 360,643 | 4/1887 | Austin | 15/257.2 |
| 690,871 | 1/1902 | O'Keefe | 15/170 |
| 760,391 | 5/1904 | Fuller | 15/257.2 |
| 870,447 | 11/1907 | Lyons | 15/257.2 |
| 1,189,051 | 6/1916 | Brooks | 15/257.2 |
| 1,197,252 | 9/1916 | Belpedio | 15/169 |
| 1,424,761 | 8/1922 | Hall | 15/257.2 |
| 1,984,491 | 12/1934 | Ozdobinski | 15/257.2 |
| 2,553,727 | 5/1951 | Schultz | 15/257.2 |
| 3,018,502 | 1/1962 | Lossius | 15/257.2 |
| 3,197,795 | 8/1965 | Forte | 15/248 R |
| 3,733,636 | 5/1973 | Osadsky | 15/111 |

*Primary Examiner*—Daniel Blum

*Attorney, Agent, or Firm*—Watts, Hoffmann, Fisher & Heinke Co.

[57] ABSTRACT

A sweeping broom of the type having a brush or head attached to a handle is combined with a flexible dustpan that is slidable along the broom handle and has a shape conforming to the curvature of the brush. When engaged on the broom handle, the dustpan can be positioned against the rear face of the brush to serve as a backing member for adjustably regulating the stiffness of the bristles, and rendering the broom adaptable for indoor and outdoor use. When removed from the broom, the flexible dustpan can be pressed flat against a floor or other sweeping surface for use with the broom in the normal manner.

2 Claims, 7 Drawing Figures

BROOM AND DUSTPAN COMBINATION

SUMMARY OF THE INVENTION

The present invention relates generally to brooms, and more specifically to a new and improved broom and dustpan combination adapted for indoor and outdoor use.

An object of this invention is to provide a broom and dustpan combination wherein the dustpan can be attached to the broom to serve as a backing member for the brush bristles.

A more specific object of the invention is to provide a broom and dustpan combination wherein the dustpan is engagable on the broom handle to serve as a backing member for the brush and wherein the pan can be slid along the broom handle to adjustably regulate the stiffness or flexibility of the brush bristles, making the broom suitable for both indoor and outdoor use.

Another object of the invention is to provide a broom and dustpan combination as previously described wherein the brush has a concavo-convex shape and the dustpan conforms to curvature of the brush.

Still another object of this invention is to provide a broom and dustpan combination as described in the previous paragraph which is further characterized in that the dustpan is made of a flexible material permitting it to be pressed flat against a floor or other sweeping surface for use in the normal manner.

Other objects and a full understanding of the invention will be had from the following detailed description and the accompanying drawings.

DESCRIPTION OF THE PREFERRED EMBODIMENT

Figure 1:
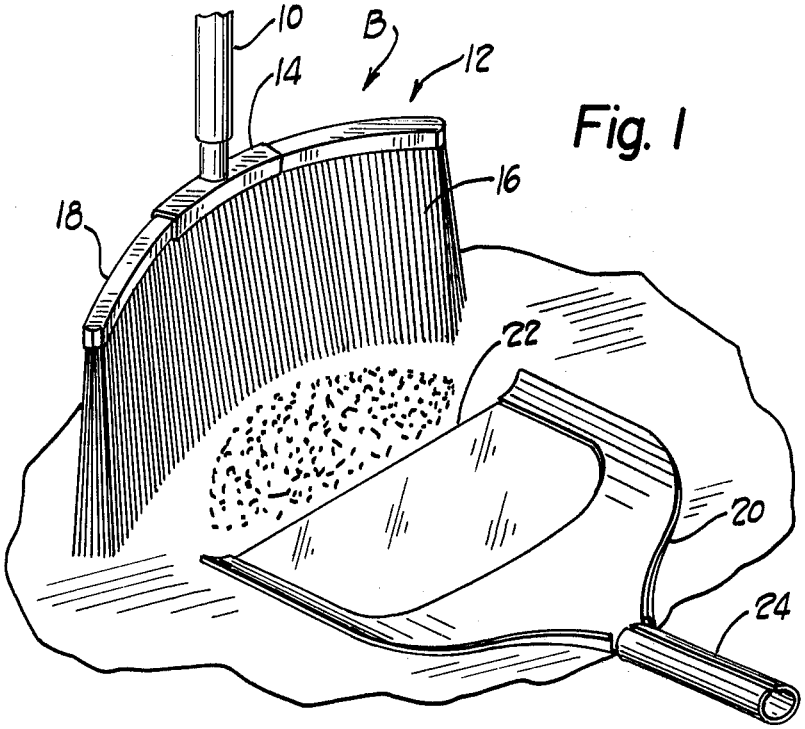
FIG. 1 is a fragmentary, pictorial view showing the broom and dustpan combination in use.
Figure 2:
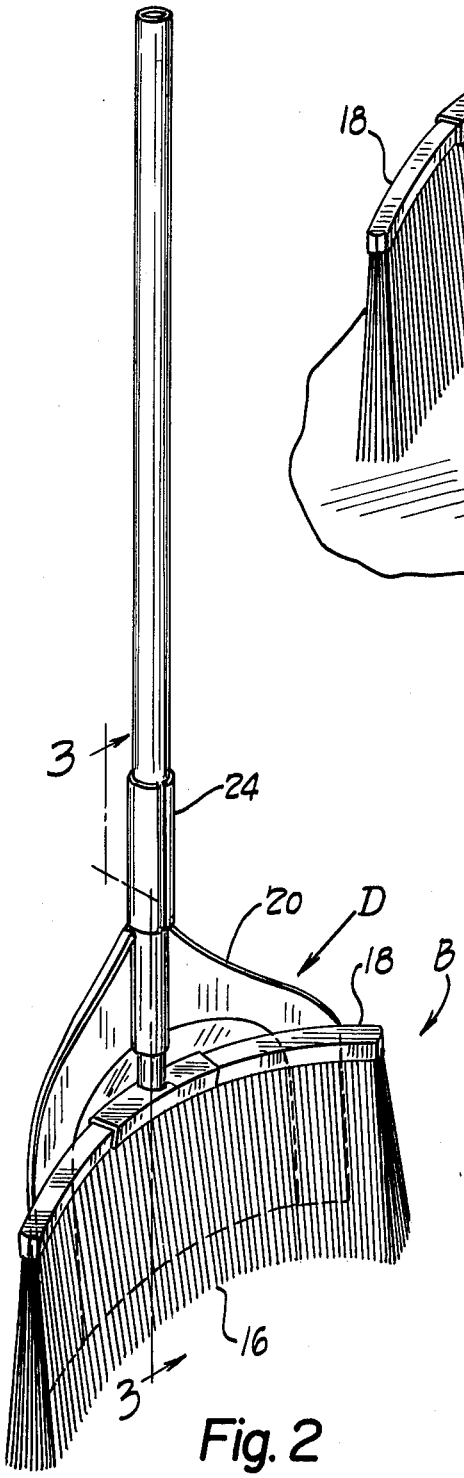
FIG. 2 is an elevational view of the invention.

Referring to the drawings, and to FIGS. 1 and 2 in particular, there is shown a broom B comprised of a tubular handle 10 and a concavo-convex brush or head 12 attached to the handle by a bracket 14. The handle 10 is a tubular member made of any suitable material such as aluminum, wood and the like. The brush or head 12 consists of bristles 16 maintained in a conventional concavo-convex configuration by engagement in a curved brush strip or retainer 18. The bracket 14 and the brush strip 18 are secured together.

Brooms of various types having concavo-convex brushes or heads are known in the art. The concavo-convex shape of the head causes the debris to be directed toward the middle of the broom's path rather than being scattered about the random ahead of the broom. As a result, the broom has a natural effect of sweeping dirt and other debris into piles which can be conveniently collected.

Figure 3:
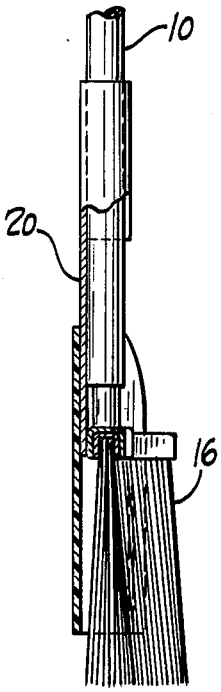
FIG. 3 is a fragmentary, side view, partially in cross-section of the invention.

In accordance with the present invention, the broom B is combined with a curved dustpan D which is engagable on the broom handle in such a way that the pan can be positioned against the convex rear face of the brush 12 to serve as a backing member for the bristles 16, as shown in FIGS. 2 and 3. The curvature of the dustpan D corresponds to that of the brush 12.

The dustpan D, when engaged on the handle 10, is slidable up and down the handle so that it is possible to regulate the effective stiffness of the bristles 16 by adjusting the relative positioning of the dustpan D on the broom handle 10.

Notwithstanding its curvature, the dustpan D, when disengaged from the broom handle 10, can be deformably pressed flat against a floor or other sweeping surface for use in the normal manner. This feature is made possible by making the dustpan at least partially of flexible material.

Figure 4:
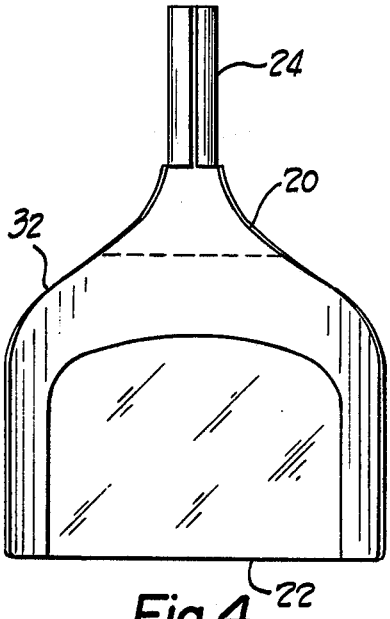
FIG. 4 is a top plan view of the dustpan shown in FIGS. 1 and 2.
Figure 5:
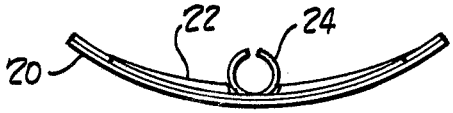
FIG. 5 is an end elevational view of the dustpan shown in FIG. 4.

In the construction illustrated in FIGS. 1, 4 and 5, the dustpan D includes a handled frame portion 20 which supports a flexible plastic member 22. The flexible member 22 provides a surface which, in its unstressed condition, has a curvature conforming to that of the brush 16. At the same time, the member 22 can be pressed flat against a sweeping surface to collect the piles of debris formed by the broom.

The dustpan D is slidably engagable on the broom handle 10 by a generally tubular handle portion 24 integrally formed with the frame portion 20. The dustpan handle portion 24 has a friction fit on the broom handle 10 and permits the dustpan to be slid up and down the broom handle to back up the convex face of the brush 12 to an adjustable degree, as generally described above. The relative positioning of the dustpan D along the broom handle 10 with respect to the distal ends of the bristles 16 governs the effective stiffness of the bristles.

The adjustable bristle stiffness enables the adaptation of the broom for use in a variety of applications. For example, the dustpan D can be moved up the broom handle 10 to provide for increased flexibility of the bristles when the broom is used indoors or when the debris is lightweight. When greater stiffness is desired, as for outdoor use, such as sweeping lawns or driveways or when the debris is selectively heavy, the dustpan D is preferably moved down the handle to make the bristles stiffer.

While the feature of a dustpan mounted on a broom in such a way as to provide means for adjustably regulating the stiffness of the bristles is illustrated in conjunction with a concavo-convex brush, it is to be understood that this feature also can be provided in combination with a more conventional type broom.

Figure 6:
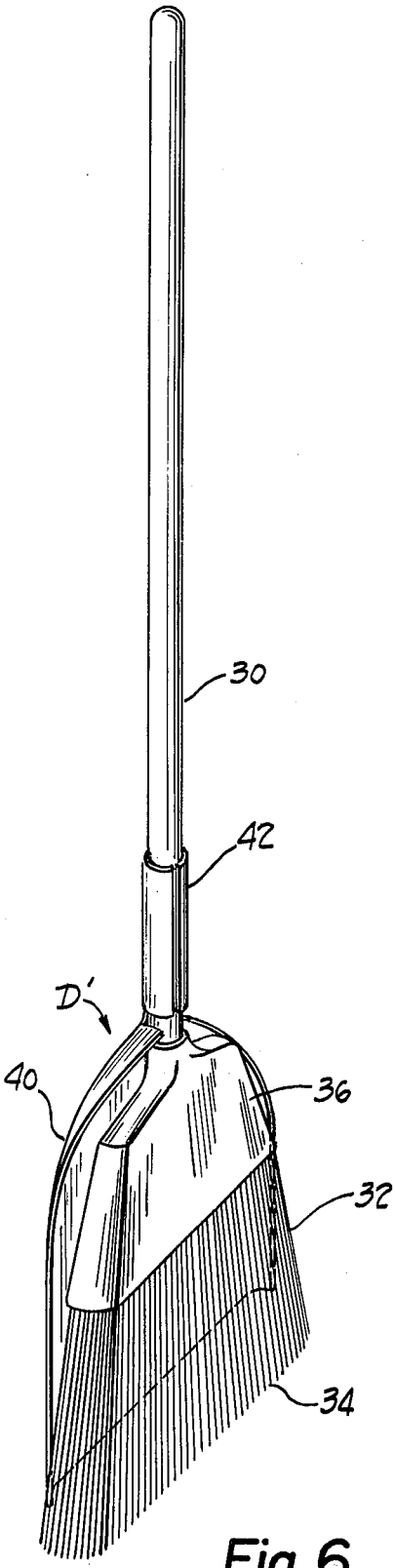
FIG. 6 is an elevational view of another embodiment.
Figure 7:
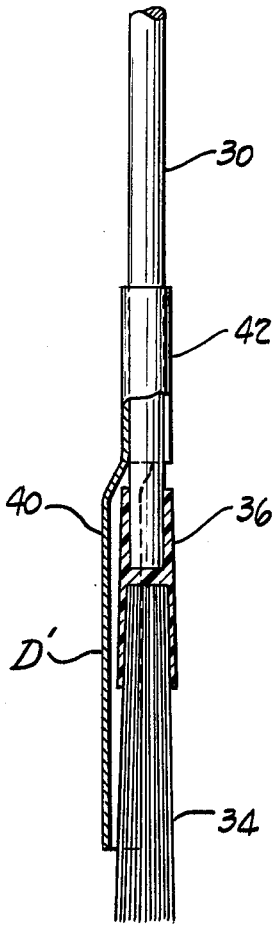
FIG. 7 is a fragmentary, partially cross-sectional view of the embodiment of FIG. 6.

Referring to FIGS 6 and 7, the broom B is shown in this embodiment as a conventional broom having a handle 30, constructed similarly to the handle 10 in the previous embodiment, and a conventional head or brush 32 including a plurality of bristles 34 attached to the handle. The bristles can be attached to the handle 30 in a generally linear array by an ordinary brush retainer 36.

The dustpan D' used in this embodiment can suitably be a dustpan made of a single integral piece 40, made of metal, plastic, or other rigid material and having a generally flat configuration. As in the previous embodiment, the dustpan has a handled portion 42 with a generally tubular configuration, designed for a slidable, friction fit engagement on the handle 30. This structure permits the dustpan to be used on the broom to effectively regulate bristle stiffness, in a manner analogous to that described above.

Many other modifications and variations of the invention will be apparent to those skilled in the art in light of the foregoing disclosure. Therefore, within the scope of the appended claims, the invention can be practiced otherwise than as specifically shown and described.

What is claimed is:

1. In combination, a broom having a handle and a brush comprised of a concavo-convex array of bristles connected to said handle, and a dustpan adapted to be removably mounted on said broom with a portion of said dustpan positioned adjacent one face of said brush to serve as a backing member for said bristles, said dustpan including mounting means engageable with said broom for permitting said dustpan to be adjustably moved toward and away from the distal ends of the bristles to regulate their effective stiffness, said dustpan being flexible, and in its undeformed condition having a curvature substantially conforming to the curvature of said concavo-convex array.

2. In combination, a broom having a tubular handle and a brush comprised of a concavo-convex array of bristles at one end of said handle, and a dustpan removably mointed on said broom, said dustpan having a flexible portion positionably adjacent one face of said brush to serve as a backing member for said bristles and sleeve means slidable along said handle so that said portion of said dustpan can be moved toward and away from the distal ends of said bristles to regulate their effective stiffness, wherein said dustpan includes a flexible portion which in its undeformed condition has a curvature substantially conforming to the shape of said concavo-convex array of bristles.

* * * * *